US005090093A

United States Patent [19]

Kelly

[11] Patent Number: 5,090,093

[45] Date of Patent: Feb. 25, 1992

[54] ORGANIC COMMINUTING APPARATUS

[76] Inventor: Ralph B. Kelly, 2785 Arbutus Road, Victoria, B.C., Canada, V8N5X6

[21] Appl. No.: 685,886

[22] Filed: Apr. 16, 1991

[51] Int. Cl.[5] ..... B02C 23/00

[52] U.S. Cl. ..... 24/38; 241/101.2; 241/282.2; 241/285.2

[58] Field of Search ..... 241/101.2, 285 A, 282.1, 241/282.2, 38

[56] References Cited

U.S. PATENT DOCUMENTS

| | | | |
|---|---|---|---|
| 3,107,600 | 10/1963 | Brun-Buisson | 241/101.2 X |
| 3,612,125 | 10/1971 | Krauth | 241/38 X |
| 4,011,999 | 3/1977 | Glaeser | 241/DIG. 38 X |
| 4,020,992 | 5/1977 | Binger et al. | 241/DIG. 38 X |
| 4,076,177 | 2/1978 | Hirayama et al. | 241/DIG. 38 X |
| 4,533,507 | 8/1985 | Tao | 241/38 X |
| 4,600,155 | 7/1986 | Bos et al. | 241/282.1 X |
| 4,624,177 | 11/1986 | Ito et al. | 241/101.2 X |
| 4,784,340 | 11/1988 | Totai et al. | 241/DIG. 38 X |
| 4,799,626 | 1/1989 | Hickel et al. | 241/282.1 X |
| 4,852,817 | 8/1989 | Tipton | 241/DIG. 38 X |

*Primary Examiner*—Mark Rosenbaum
*Assistant Examiner*—Frances Chin
*Attorney, Agent, or Firm*—Leon Gilden

[57] ABSTRACT

An apparatus including a longitudinally aligned housing with a lid securable thereover, wherein a comminuting chamber is removably mounted in alignment with an upper edge of the housing, wherein the comminuting chamber includes a rotatable drive shaft selectively received within a drive socket. The comminuting chamber is removable and permits directing of comminuted organic matter into an underlying centrifuge bowl, whereupon organic fluid is removed from the organic matter and directed exteriorly of the housing through an associated conduit.

6 Claims, 5 Drawing Sheets

PRIOR ART

ORGANIC COMMINUTING APPARATUS

BACKGROUND OF THE INVENTION

1. Field of the Invention

The field of invention relates to comminuting apparatus, and more particularly pertains to a new and improved organic comminuting apparatus wherein the same permits extraction of recyclable organic matter removed from grass clippings and the like for replenishment of soil.

2. Description of the Prior Art

Comminuting apparatus of various types has been set forth in the prior art. It is heretofore acknowledged that during typical grass growing seasons extensive quantities of fertilizer are directed into the soil to assist in a grass growing scenario. The grass thusly grown is subsequently cut and discarded. The instant invention attempts to overcome deficiencies of the prior art by extracting chemical nutrients from the grass to permit recycling of the nutrients in a safe and economical manner. Examples of prior art comminuting apparatus are available in the prior art. For example, U.S. Pat. No. 4,020,992 to Binger sets forth a method and apparatus for separating plastic liners from metal closures, wherein a hammer mill separates pre-cooled liners and closure assemblies for subsequent separation.

U.S. Pat. No. 4,784,340 to Tatai, et al sets forth an apparatus for comminuting organic matter, including a compacting and comminuting arrangement to direct organic matter into an associated comminuting chamber from a hopper assembly.

U.S. Pat. No. 4,011,999 to Glaeser sets forth a self-cleaning trash shredder arranged to spread out the shredded trash for later separation of magnetic portions therefrom.

U.S. Pat. No. 4,076,177 to Hirayama, et al sets forth an apparatus for use in pulverizing and segregation of various materials further utilizing beaters disposed within the pulverizing chamber provided with safety means permitting the beaters to pivot when a relatively stiff workpiece quantity is directed within the apparatus.

U.S. Pat. No. 4,852,817 to Tipton sets forth a comminuting apparatus for breaking up food containers and for recovering food product from the aforenoted containers.

As such, it may be appreciated that there continues to be a need for a new and improved organic matter comminuting apparatus wherein the same is provided to comminute organic matter and extract in a liquefied form the central organic constituents of the organic matter.

SUMMARY OF THE INVENTION

In view of the foregoing disadvantages inherent in the known types of comminuting apparatus now present in the prior art, the present invention provides an organic matter comminuting apparatus wherein the same directs comminuting apparatus to be centrifuged in a subsequent operation within the apparatus for removal of various organic liquid constituents from the organic matter. As such, the general purpose of the present invention, which will be described subsequently in greater detail, is to provide a new and improved organic matter comminuting apparatus which has all the advantages of the prior art comminuting apparatus and none of the disadvantages.

To attain this, the present invention provides an apparatus including a longitudinally aligned housing with a lid securable thereover, wherein a comminuting chamber is removably mounted in alignment with an upper edge of the housing, wherein the communiting chamber includes a rotatable drive shaft selectively received within a drive socket. The comminuting chamber is removable and permits directing of comminuted organic matter into an underlying centrifuge bowl, whereupon organic fluid is removed from the organic matter and directed exteriorly of the housing through an associated conduit.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved organic matter comminuting apparatus which has all the advantages of the prior art comminuting apparatus and none of the disadvantages.

It is another object of the present invention to provide a new and improved organic matter comminuting apparatus which may be easily and efficiently manufactured and marketed.

It is a further object of the present invention to provide a new and improved organic matter comminuting apparatus which is of a durable and reliable construction.

An even further object of the present invention is to provide a new and improved organic matter comminuting apparatus which is susceptible of a low cost of manufacture with regard to both materials and labor, and which accordingly is then susceptible of low prices of sale to the consuming public, thereby making such organic matter comminuting apparatus economically available to the buying public.

Still yet another object of the present invention is to provide a new and improved organic matter comminuting apparatus which provides in the apparatuses and methods of the prior art some of the advantages thereof, while simultaneously overcoming some of the disadvantages normally associated therewith.

Still another object of the present invention is to provide a new and improve organic matter comminuting apparatus wherein the same permits removal of chemical constituent from comminuted organic matter to permit recycling of the liquid constituent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
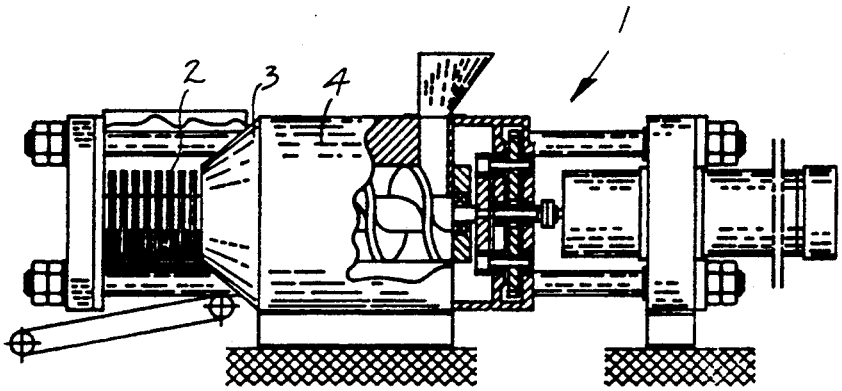
FIG. 1 is an orthographic side view, partially in section, of a prior art comminuting apparatus for use with organic matter.

With reference now to the drawings, and in particular to FIGS. 1 to 8 thereof, a new and improved organic matter comminuting apparatus embodying the principles and concepts of the present invention and generally designated by the reference numeral 10 will be described.

Figure 2:
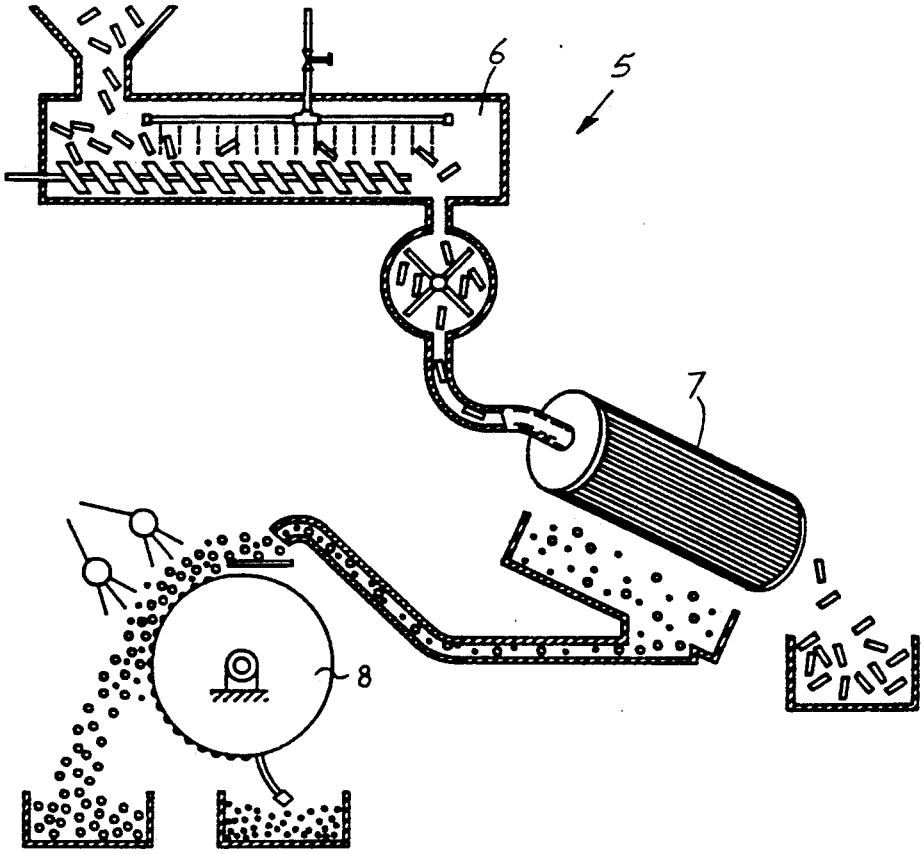
PRIOR ART FIG. 2
FIG. 2 is a diagrammatic illustration of a further prior art comminuting apparatus.

FIG. 1 illustrates a prior art organic matter comminuting apparatus 1 utilizing a comminuting chamber 2 in cooperation with the compacting chamber 3 and a feeding and precompacting portion 4 to direct organic matter through the apparatus from an associated hopper. FIG. 2 illustrates a further prior art comminuting apparatus 5 wherein a pre-cooling chamber 6 directs liquid nitrogen onto a workpiece, wherein a rotary chamber 7 permits separation of the workpiece in cooperation with a high tension electrical separator 8.

More specifically, the organic matter comminuting apparatus 10 of the instant invention essentially comprises an elongate longitudinally aligned cylindrical housing 11, including an open upper end, with a lid 12 hingedly mounted thereto. A hinge 13 is mounted to the lid and cylindrical housing to permit the aforenoted pivotment, with a lid clasp 17 integrally mounted to the lid 12 diametrically opposed from the hinge 13 cooperative with a generally "U" shaped housing clip 18 mounted on the cylindrical housing 11 adjacent the top annular edge of the housing. A positioning boss 14 is mounted coaxially and integrally to a bottom surface of the lid 12, with an alignment recess 15 positioned therewithin to receive and position an upper end 27 of an associated rotatable drive shaft 24, to be discussed in more detail below. A safety switch 16 is mounted to the top annular edge 23 adjacent the hinge 13 that prevents actuation of an associated drive motor 31 when the lid is in a raised position, as illustrated. Coster wheels **11*a* and associated friction lock 11*b* are mounted in an equally spaced annular array to the bottom of the housing 11**.

Figure 3:
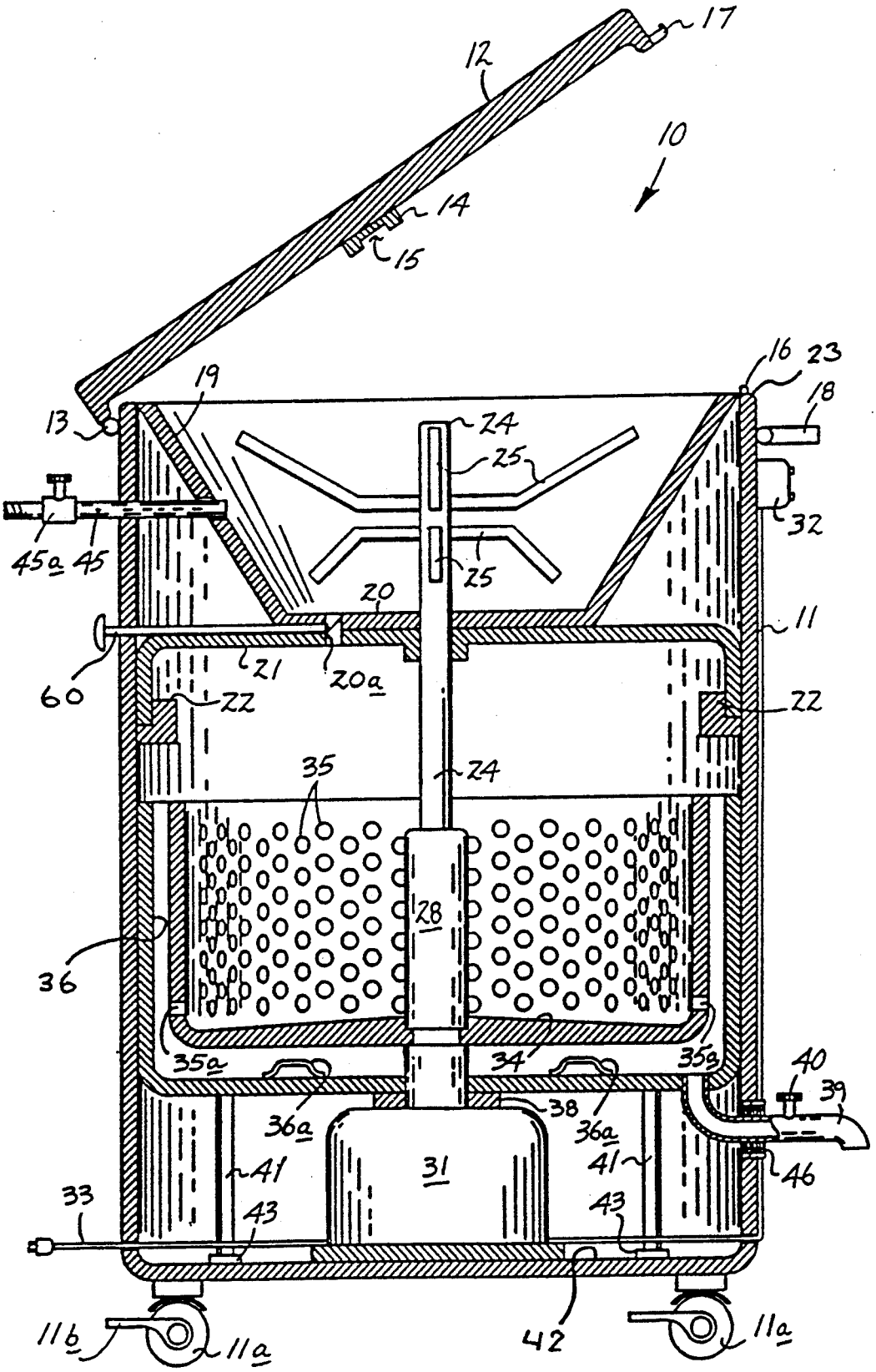
FIG. 3 is an orthographic cross-sectional view of the instant invention.
Figure 4:
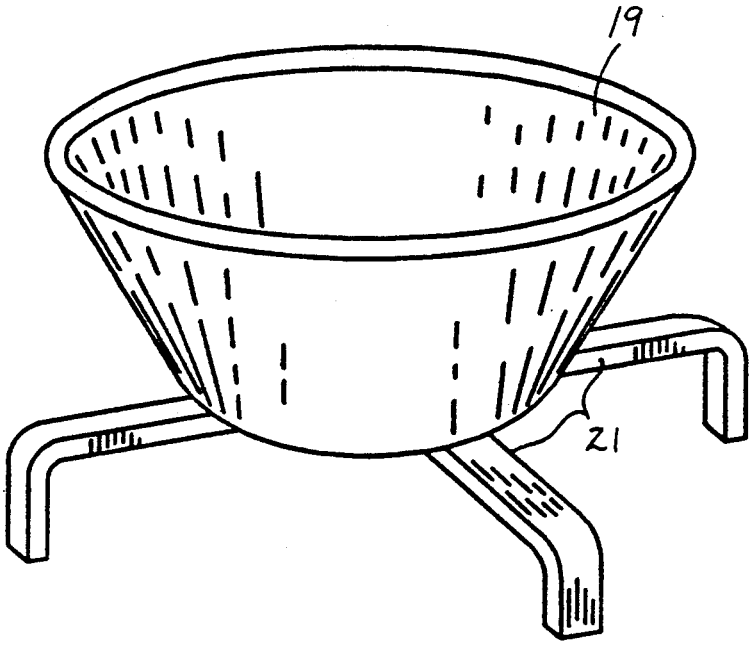
FIG. 4 is an isometric illustration of the comminuting chamber utilized by the instant invention.
Figure 5:
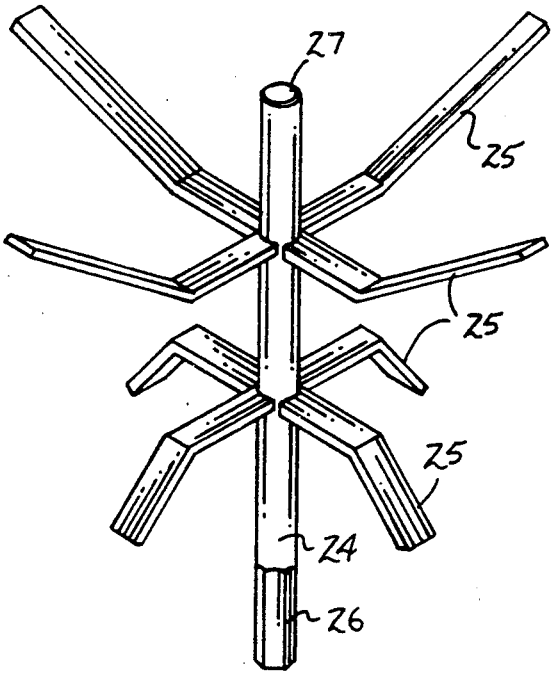
FIG. 5 is an isometric illustration of the comminuting blade utilized by the instant invention.
Figure 6:
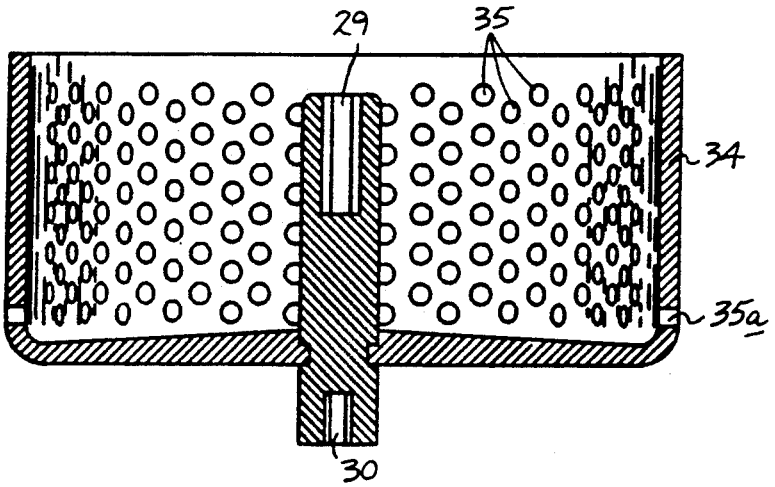
FIG. 6 is an orthographic side view, taken in elevation, of the centrifuge chamber utilized by the instant invention.
Figure 7:
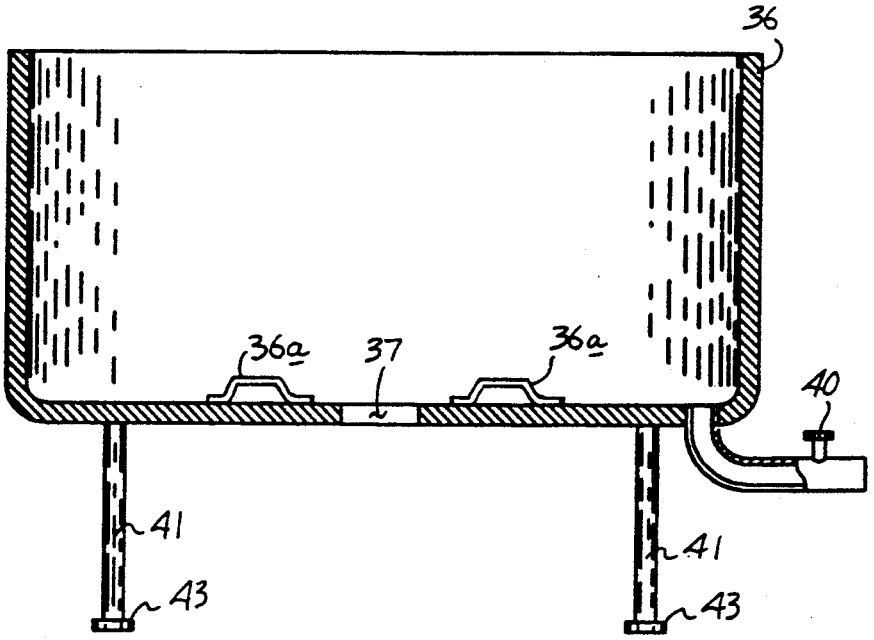
FIG. 7 is an orthographic cross-sectional view, taken in elevation, of the reservoir bowl utilized in association with the centrifuge chamber.
Figure 8:
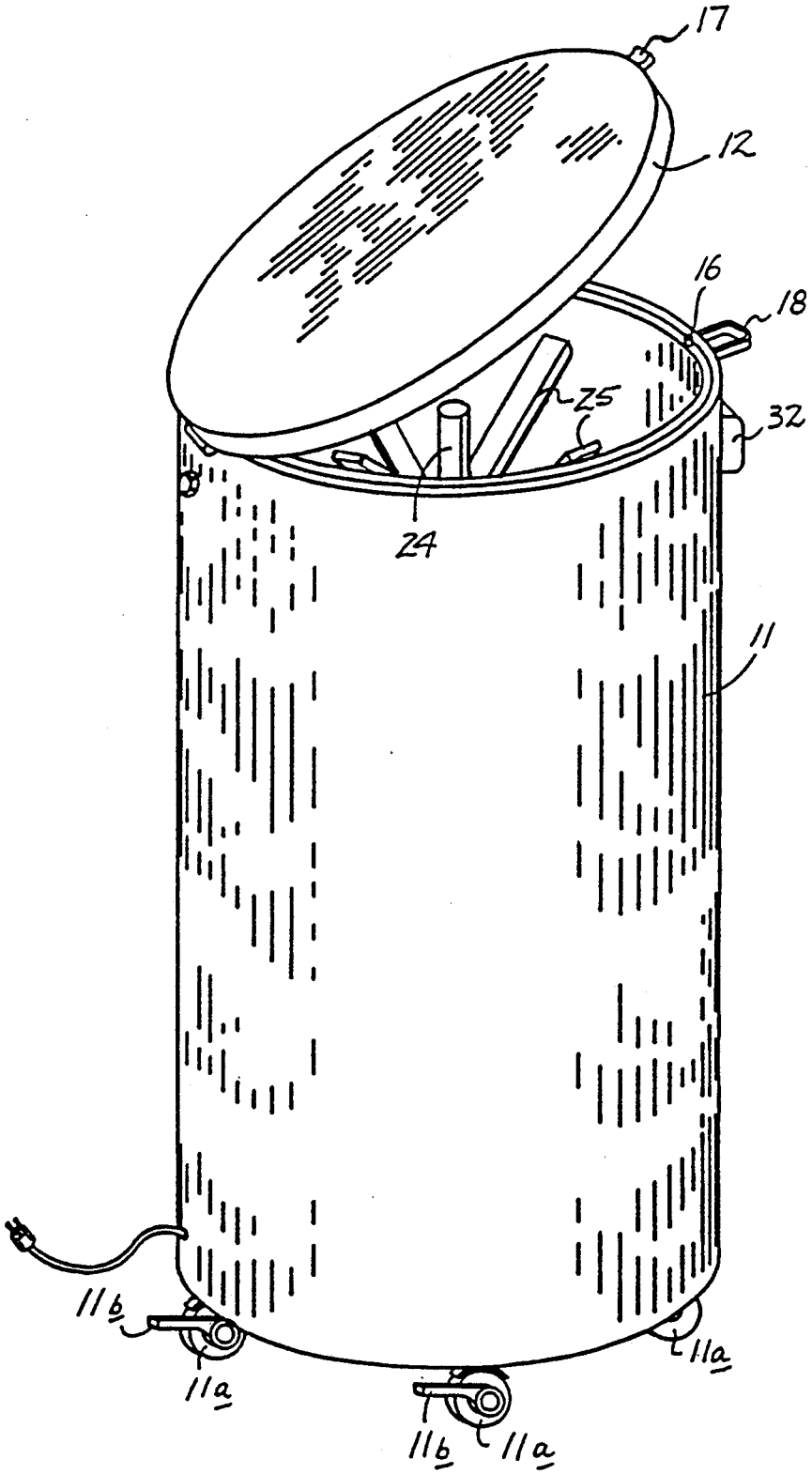
FIG. 8 is an isometric illustration of the instant invention.

A comminuting chamber 19 is positionable within the housing 11 and is configured as a truncated invertible conical member defining a trucated bowl-like cavity to receive various organic matter such as grass therewithin. The comminuting chamber 19 includes a planar bottom wall 20 fixedly mounted to a plurality of inverted "U" shaped supports 21 that are orthogonally aligned relative to one another and are mounted to a bottom surface of the bottom wall 20. The "U" shaped supports 21 each include downwardly depending leg members that are received within pairs of diametrically opposed recesses 22, as illustrated in FIG. 3 for example. The recesses 22 are defined by "L" blocks removably mounted to the interior of the housing to permit removal of the reservoir bowl 36 for cleaning and maintenance. This secures and locks the comminuting chamber in a fixed position relative to the housing 11. The top annular edge of the comminuting chamber 19 is aligned with the top annular edge of the the housing 11, as illustrated, to confine all comminuting activity within the chamber 19 when the lid 12 is in a lowered position relative to the housing 11. Further, a drainage aperature **20*a* is directed through the floor 20 overlie an underlying centrifuge bowl 34. A valve rod 60 is reciprocatably mounted orthogonally through the housing 11 to permit selective sealing of the drainage aperture 20*a*. Also, the floor of the centrifuge bowl 36 is conically provided defining an axially aligned raised surface to enhance fluid flow to the surrounding second apertures. The rotatable drive shaft 24 is rotatably mounted to the comminuting chamber 19 and fixedly mounts an upper and lower array of blades 25 within the chamber 19. The blades 25 define upper an lower coaxially aligned cones of revolution, wherein the aforenoted cone of revolution is positioned adjacent the interior wall surface of the comminuting chamber 19. Each of the "U" shaped blades 25 deflect comminuting activity into the comminuting chamber 19 during use. The lowermost end portion of the rotatable drive shaft 24 includes a lower hexagonal drive end 26 receivable within an upper intermediate shaft socket 29 coaxially formed within an upper end portion of an intermediate shaft 28. A lower intermediate shaft socket 30 is coaxially aligned with the upper socket 29 to be mounted to an associated drive motor 31 that is fixedly mounted to the interior floor surface of the housing 42. A dual speed control assembly 32 is mounted to the housing 11 to effect operative engagement of the drive motor and the drive shaft 24 upon securement of the lid in cooperation with the housing clasp 18. An electrical power cord supply 33 is provided to direct electrical power to the aforenoted motor 31**.

Subsequent to comminution of the grass clippings and organic matter within the comminuting chamber 19, the comminuting chamber 19 is removed, whereupon the processed organic matter may be deposited within the underlying centrifuge bowl 34 fixedly mounted to the intermediate shaft 28 for additional processing or merely discarded. The centrifuge bowl 34 includes a matrix of off-set rows and columns of apertures 35 of a first diameter to direct and separate organic fluid from the organic matter outwardly therefrom into the surrounding reservoir bowl 36. An annular array of second apertures 35*a* of a second diameter greater than the first diameter permits directing of flow of a liquid within to the surrounding reservoir bowl 36. The second apertures 35*a* are positioned adjacent the floor of the centrifuge bowl 34. The reservoir bowl 36 is defined by an external diameter substantially equal to the internal diameter of the housing 11. The centrifuge bowl 34 is defined by an external diameter less than that of the internal diameter of the reservoir bowl 36 to permit directing of fluid from the centrifuge chamber into the reservoir bowl 36 and outwardly therefrom through a fluid conduit 39 directed through the floor of the reservoir bowl 36 and exteriorly of the housing 11 utilizing a valve 40 to permit selective flow of the organic fluid from the reservoir bowl 36. An intermediate shaft opening 37 is provided coaxially through the floor of the reservoir bowl 36 and cooperates with a fluid seal 38 captured between the reservoir bowl floor and the upper surface of the motor 31 to provide a fluid containment chamber within the reservoir bowl 36 to prevent leakage interiorly of the housing 11. The reservoir bowl 36 is provided with support legs 41, including polymeric pads 43 to enhance frictional engagement of the reservoir bowl 36 with the interior floor surface 42 of the housing 11. It is understood accordingly that the various components of the apparatus may be removed for subsequent cleaning, such as the comminuting chamber 19, the centrifuge bowl 34, and the reservoir bowl 36. It is illustrated that a pair of diametrically aligned "U" shaped handles 36*a* are provided and integrally mounted to the floor of centrifuge bowl 36 to ease this effort. Understandably, the valve 40 is provided with adequate clearance through the wall of the housing 11 to permit its extraction through the wall for removal during a cleaning procedure. Further, it should be understood that during comminuting of various organic matter within the comminuting chamber 19, simultaneous centrifuge of a previous amount comminuted organic matter is desired to be processed within the centrifuge bowl 34.

A "wash-out" conduit 45 and vave 45*a* are provided and removably mounted through the housing 11 into the chamber 19, as illustrates in FIG. 3. The housing 11 is also provided with a threaded plug 46 receiving the fluid drain conduit 39 therethrough for a sealing relationship. The drain conduit 39 is directed through a floor of the reservoir conduit 36.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A comminuting apparatus comprising, in combination, an elongate longitudinally aligned cylindrical housing, including a top annular edge coaxially aligned to the cylindrical housing, with a lid pivotally mounted to the cylindrical housing overlying the top annular edge, and a drive motor fixedly mounted to a bottom floor of the cylindrical housing, the drive motor including an intermediate shaft mounted to the drive motor, and a rotatable drive shaft separably mounted to the intermediate shaft, and a comminuting chamber removably mounted within the cylindrical housing in a surrounding relationship to the blades, and wherein the intermediate shaft includes a lower socket formed within a lower portion of the intermediate shaft and an upper socket formed within an upper portion of the intermediate shaft, and the drive shaft includes a lower drive end complementarily received within the upper socket, and a centrifuge bowl coaxially and integrally mounted to the intermediate shaft, the centrifuge bowl including a matrix of apertures directed therethrough and includes a conical floor, wherein the centrifuge bowl is coaxially aligned with and underlying the comminuting chamber, the centrifuge bowl includes an annular array of further apertures directed through the centrifuge bowl adjacent the floor, the further apertures defining a second diameter greater than the first diameter defined by each of the apertures, and including a reservoir bowl positioned in surrounding relationship relative to the centrifuge bowl, the reservoir bowl including an external diameter substantially equal to an internal diameter defined by the cylindrical housing, and the centrifuge bowl defining an external diameter substantially less than that of an internal diameter defined by the reservoir bowl to define a spacing between the reservoir bowl and the centrifuge bowl, and a fluid conduit mounted through a floor of the reservoir bowl, the fluid conduit directed through a housing opening within the cylindrical housing to direct fluid from the reservoir bowl exteriorly of the cylindrical housing, and the reservoir bowl including a floor with a plurality of handles diametrically mounted to the floor to enhance ease of removal of the reservoir bowl from the housing.

2. An apparatus as set forth in claim 1 wherein the fluid conduit includes a valve positioned exteriorly of the cylindrical housing to provide selective flow from the reservoir bowl through the fluid conduit.

3. An apparatus as set forth in claim 2 wherein the comminuting chamber is defined as a truncated inverted conical bowl member, the truncated conical bowl member including an upper terminal annular bowl end aligned with and contiguous with the top annular edge of the cylindrical housing when the comminuting chamber is positioned within the cylindrical housing, and a comminuting chamber floor includes a plurality of drainage apertures overlying the centrifuge bowl.

4. An apparatus as set forth in claim 3 wherein the comminuting blades are "U" shaped and define a plurality of truncated coaxially aligned cones of revolution upon rotation of the blades, and the cone of revolution are positioned to extend adjacent to an interior surface of the comminuting chamber.

5. An apparatus as set forth in claim 4 wherein the comminuting chamber includes a rigid floor, the rigid floor including a plurality of "U" shaped supports integrally mounted to the floor, the plurality of "U" shaped supports are orthogonally aligned relative to one another, and each of the "U" shaped supports include a plurality of downwardly depending legs, each of the downwardly depending legs receivable within diametrically aligned pairs of recessed members, the recessed members fixedly mounted to an interior surface of the cylindrical housing.

6. An apparatus as set forth in claim 5 wherein the lid includes a positioning boss coaxially and fixedly mounted to an interior surface of the lid, the positioning boss includes an alignment recess, and the drive shaft includes an upper terminal end, the upper terminal end is receivable within the alignment recess when the lid is in a closed configuration overlying the top annular edge of the cylindrical housing.

* * * * *